United States Patent [19]

Fendrik

[11] Patent Number: 4,624,458

[45] Date of Patent: Nov. 25, 1986

[54] SELF-ADJUSTING FOOT HOLDING STRUCTURE FOR A TILTABLE BODY EXERCISER

[76] Inventor: Steven I. Fendrik, 2024 North Sycamore Ave., Los Angeles, Calif. 90068

[21] Appl. No.: 568,352

[22] Filed: Jan. 5, 1984

[51] Int. Cl.[4] ..... A63B 17/00

[52] U.S. Cl. ..... 272/145; 128/71; 128/75

[58] Field of Search ..... 272/145, 144, 134, 33 R, 272/62; 128/70, 24 R, 71, 75, 33, 68, 80 R

[56] References Cited

U.S. PATENT DOCUMENTS

| | | | |
|---|---|---|---|
| 3,081,085 | 3/1963 | Girolamo | 272/145 |
| 3,152,802 | 10/1964 | Heisler et al. | 128/71 |
| 3,286,708 | 11/1966 | Gartner | 272/145 |
| 3,568,669 | 3/1971 | Stites | 128/71 |
| 3,589,358 | 6/1971 | Megal | 128/71 |
| 4,114,613 | 9/1978 | Kuhn | 128/71 |
| 4,170,988 | 11/1977 | Krause | 128/24 R |
| 4,232,662 | 11/1980 | Barber | 128/71 |
| 4,367,731 | 1/1983 | Barber | 128/71 |
| 4,438,761 | 3/1984 | McGowen | 128/75 |
| 4,534,555 | 8/1985 | McGowen | 272/145 |

*Primary Examiner*—Richard J. Apley
*Assistant Examiner*—John L. Welsh
*Attorney, Agent, or Firm*—B. F. Spencer

[57] ABSTRACT

A self-adjusting foot holding structure for embracing the back of the leg and the top of the foot is disclosed for use with a tiltable body exerciser. The foot holding structure includes left and right laterally displaced U-shaped leg embracing pads supported, respectively, near the upper end of a carriage member. The carriage support member is slidable mounted along the lower end of the elongated, central frame member of the tiltable body exerciser. Left and right laterally displaced inverted U-shaped pads for embracing the top of each foot are slidably mounted, respectively, upon the upwardly extending section of an inclined bracket member. The base portion of the inclined bracket member is either rigidly or slidably attached to the upper surface of the carriage member near its lower end. The inclined bracket member extends along the central portion of the slidable carriage member with its upwardly extending section lying in a plane inclined at an acute angle with respect to the plane of the upper surface of the slidable carriage member. A laterally extending left and right foot rest is attached to the carriage member at a position below the upwardly extending section of the inclined bracket member. A spring-loaded locking pin assembly, with a manual release knob, is attached to the top surface of the carriage member near its upper end. The self-adjusting foot holding structure is positionable along the elongated, central frame member by manually releasing the locking pin and sliding the carriage member to any desired position.

7 Claims, 8 Drawing Figures

SELF-ADJUSTING FOOT HOLDING STRUCTURE FOR A TILTABLE BODY EXERCISER

BACKGROUND OF THE INVENTION

The present invention relates to tiltable body exercisers for the therapeutic treatment of the human body, and, in particular, to improved foot and leg holding devices for such exercisers.

Tiltable body exercisers are weel known in the art. A number of representative examples are disclosed in U.S. Pat. Nos. 1,693,810; 2,786,512; 3,081,085; 3,152,802; 3,286,708; 3,568,669; 3,589,358; 4,170,988 and 4,232,662. These exercisers are characterized by a body supporting structure pivotally mounted about a horizontal axis upon a sturdy A-frame or similar structure. The body supporting structure includes an upper body supporting portion, i.e., a bed or platform; a lower body supporting portion, i.e., a foot, ankle, instep or leg embracing structure; and an elongated central frame member or boom interconnecting the upper and lower supporting portions.

A patient using the exerciser may achieve horizontal, inclined or inverted positions of the body by the shifting of the center of gravity of the body relative to the horizontally extending pivot axis. This positioning of the patient may be achieved in a number of ways, examples of which are illustrated in the above-identified U.S. patents.

One method of adjusting the balance or center of gravity of the patient with respect to the pivot axis is by providing a foot holding mechanism supported by a carriage member that is slidably adjustable along the lower end portion of the elongated central frame member. U.S. Pat. Nos. 4,114,613; 4,367,731; and the above-mentioned U.S. Pat. Nos. 3,589,358 and 4,232,662 disclose slidable carriage foot holding structures.

A variety of foot, ankle, instep and leg holding devices are employed to secure the patient for inclined or inverted positions, as may be seen in the above-identified U.S. patents. In addition to these structures, a different type of foot or leg securing device is the inversion boot individually worn, one on the left leg and one on the right leg, as disclosed in U.S. Pat. No. 3,380,447. Each inversion boot is provided with a hook for grasping a horizontally mounted bar, thereby enabling the body to be suspended in an inverted, hanging position.

The human body may be suspended in an inverted, hanging position by means of another device which employs but a single hook. This device consists of a rigid bar or strap, one end of which is bent in the shape of a hook. The other end is provided with a securely attached T-mounted hand grip. The rigid bar is bent slightly, intermediate the hook end and the T-mounted hand grip, about an axis parallel to the axis of the hook. First laterally displaced left and right cup-shaped padded members are securely bolted to the rigid bar, intermediate the hook and T hand grip, for embracing, respectively, the rear sides of the left and right legs adjacent the ankles. Second laterally displaced left and right cup-shaped padded members are securely bolted to an inclined portion of the rigid bar, at a position between the hook and the first laterally displaced left and right cup-shaped members, for embracing, respectively, the instep area of the left and right foot.

To invert with this latter device, the user must first attach the hook upon a securely mounted, horizontally extending support bar. The left and right hands of the user must then grasp the T-mounted hand grip. By supporting the body from the T-mounted hand grip, the user inverts both feet and legs. The user then inserts the right foot and leg in between the laterally displaced right first and second cup-shaped padded members and then inserts the left foot and leg in between the laterally displaced left first and second cup-shaped members. When both feet and legs are secured in position, the user may release the grasp of his hands upon the T hand grip, thereby achieving inverted body suspension.

Alternatively, the above-described single hook device may be pivotally attached or hooked to the lower end of the central frame member of a tiltable body exerciser, as by means of a bolt or rod. The bolt or rod may be attached to the end of an arm member extending outwardly from the lower end of the central frame member. Horizontal, inclined or inverted body positions may be achieved with this arrangement by shifting the center of gravity of the user relative to the horizontally extending pivot axis of an A-frame structure.

Many of the problems encountered with the above-mentioned exercisers are associated with the failure of these devices to hold the feet of the patient with the comfort desired, especially if prolonged inverted body suspension is desired. Additionally, a number of these devices require complex manual adjustment of ankle embracing pads and foot embracing pads to achieve a snug fit. Certain of the prior tiltable body exercisers employ detachable foot instep securing means, which must be correctly adjusted, engaged, and locked into position before inclined or inverted body suspension can be achieved. The present invention is concerned with the solution of these problems by providing a tiltable body exerciser having a self-adjusting foot and leg holding structure for securing the feet and legs in greater comfort, while at the same time eliminating the need for manual adjustments and attachments which may be susceptible to maladjustment.

Accordingly, the principal object of the present invention is to provide an improved foot and leg holding structure for supporting the human body in an inclined or inverted position upon a tiltable body exerciser.

Another object is to provide a self-adjusting foot and leg holding structure that will accommodate different sizes of feet and legs without the necessity of manual adjustments.

Yet another object is to provide a comfortable foot and leg holding structure requiring no manually adjustable attachments.

The above objects of and the brief introduction to the present invention will be more fully understood, and further objects and advantages will become apparent, from a study of the following detailed description in connection with the drawings.

DESCRIPTION OF THE INVENTION

Figure 1:
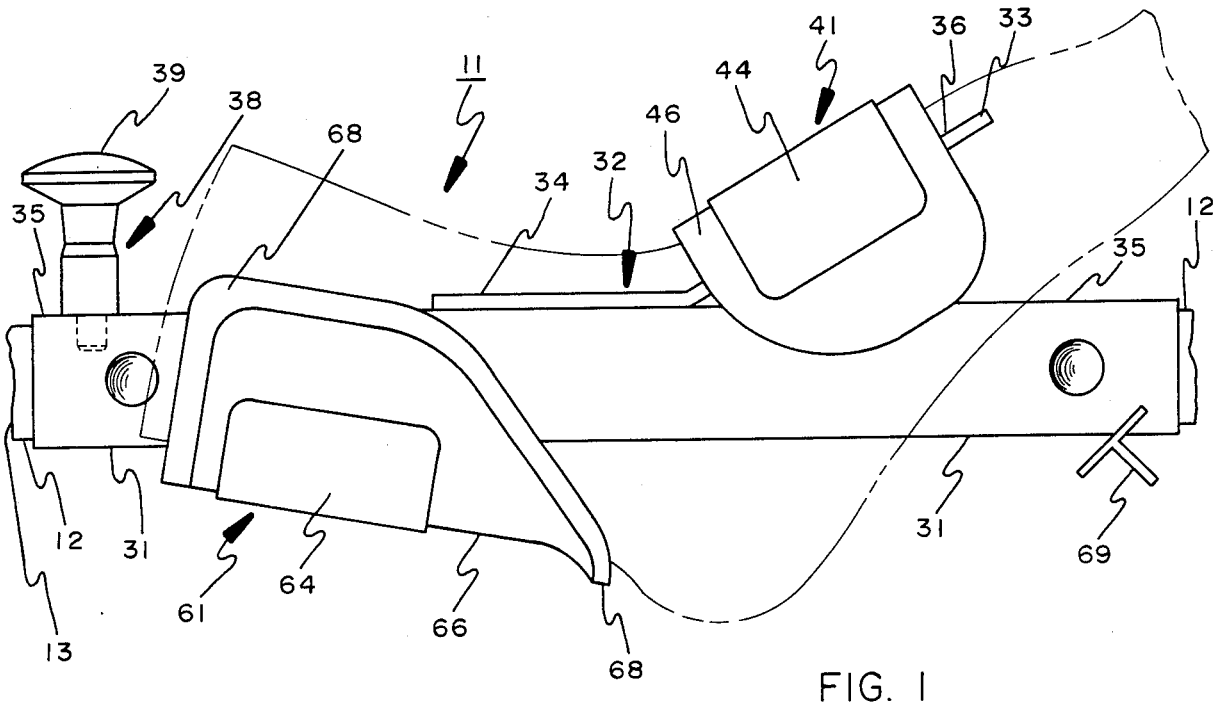
FIG. 1 is a side view of the right side of the improved, self-adjusting foot and leg holding structure of the invention.

Referring to FIGS. 1, 2, 4 and 5, where identical numerals refer to identical parts, the lower body foot and leg supporting structure 11 of the invention is shown mounted upon and slidable along a substantially square, hollow elongated central frame member 12 of a tiltable body exerciser. The upper or left-hand end 13 of central frame member 12 extends to join the upper body supporting portion of the tiltable body exerciser, as disclosed, for example, in U.S. Pat. No. 4,232,662.

The lower end 15 of central frame member 12 extends to receive and support a floor rest (not shown) of a type identified as element 21 in U.S. Pat. No. 4,367,731. The conventional floor rest includes left and right laterally extending cylindrical tube members securely attached to the end of a square support channel telescoping within the open lower end 15 of central frame member 12 and secured by a bolt.

The lower body foot and leg holding structure 11 of the invention comprises a support structure or member 31, including an inclined member 32 having an upwardly extending section 33. Support structure 31 is, preferably, a carriage member slidably mounted upon the lower end portion of the square, hollow central frame member 12. The upwardly extending section 33 of inclined member 32 may be formed as an integral part of support structure 31. Alternatively, it may be the upwardly extending section 33 of a bracket member having a base portion 34, as shown.

Carriage member 31 may be an inverted U-shaped member formed to slidably straddle hollow central frame member 12, or it may be a substantially square, hollow tube telescopingly mounted upon central frame member 12, as shown. Carriage member 31 is slidingly adjustable along frame member 12 to a number of different fixed positions. The top surface 35 of carriage member 31 is substantially flat and supports at its upper end a spring-loaded locking pin assembly 38. Locking pin assembly 38 includes a manual release knob 39 which, when raised, withdraws the locking pin to allow carriage member 31 to be adjustably positioned.

The base portion 34 of inclined bracket member 32 is shown welded to the flat, top surface 35 of carriage member 31 at a position intermediate the ends of the carriage. The top surface 36 of upwardly extending section 33 of bracket member 32 lies in a plane inclined relative to flat surface 35 by an acute angle in the range of thirty to forty-five degrees. Since the top surface 35 of slidable carriage 31 is parallel to the longitudinal axis of central frame member 12, the plane of upwardly extending surface 36 of section 33 is inclined relative to the longitudinal axis of the frame member 12.

A first transverse member 41, having a central portion 42 and left and right laterally extending end portions 43 and 44, is supported upon top surface 36 of upwardly extending section 33 for slidable movement in the plane of top surface 36. Transverse member 41 is freely slidable either in a forward direction, i.e., away from the top surface 35 of carriage 31 and toward the tip of upwardly extending section 36, or transverse member 41 is freely slidable in a backward direction, i.e., toward top surface 35 of carriage member 31.

Figure 2:
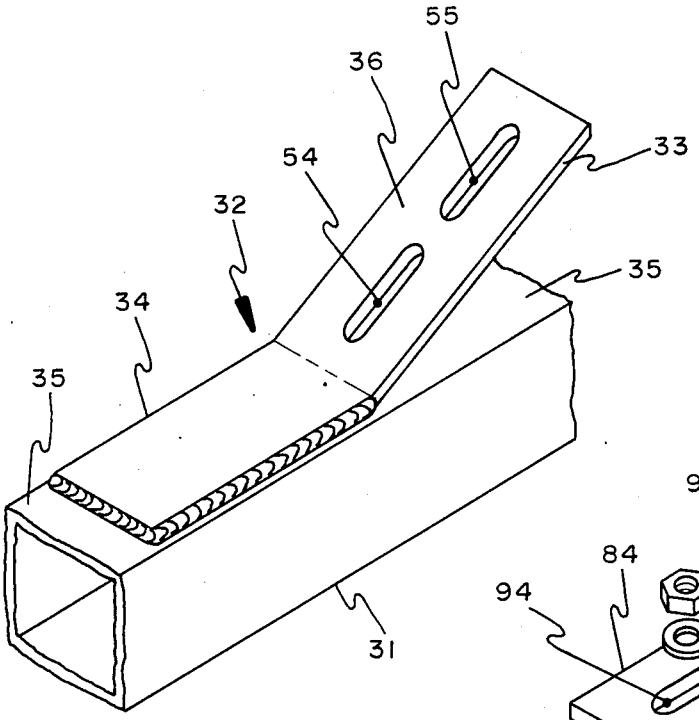
FIG. 2 is a perspective view of one embodiment of a portion of the supporting structure of the invention.
Figure 4:
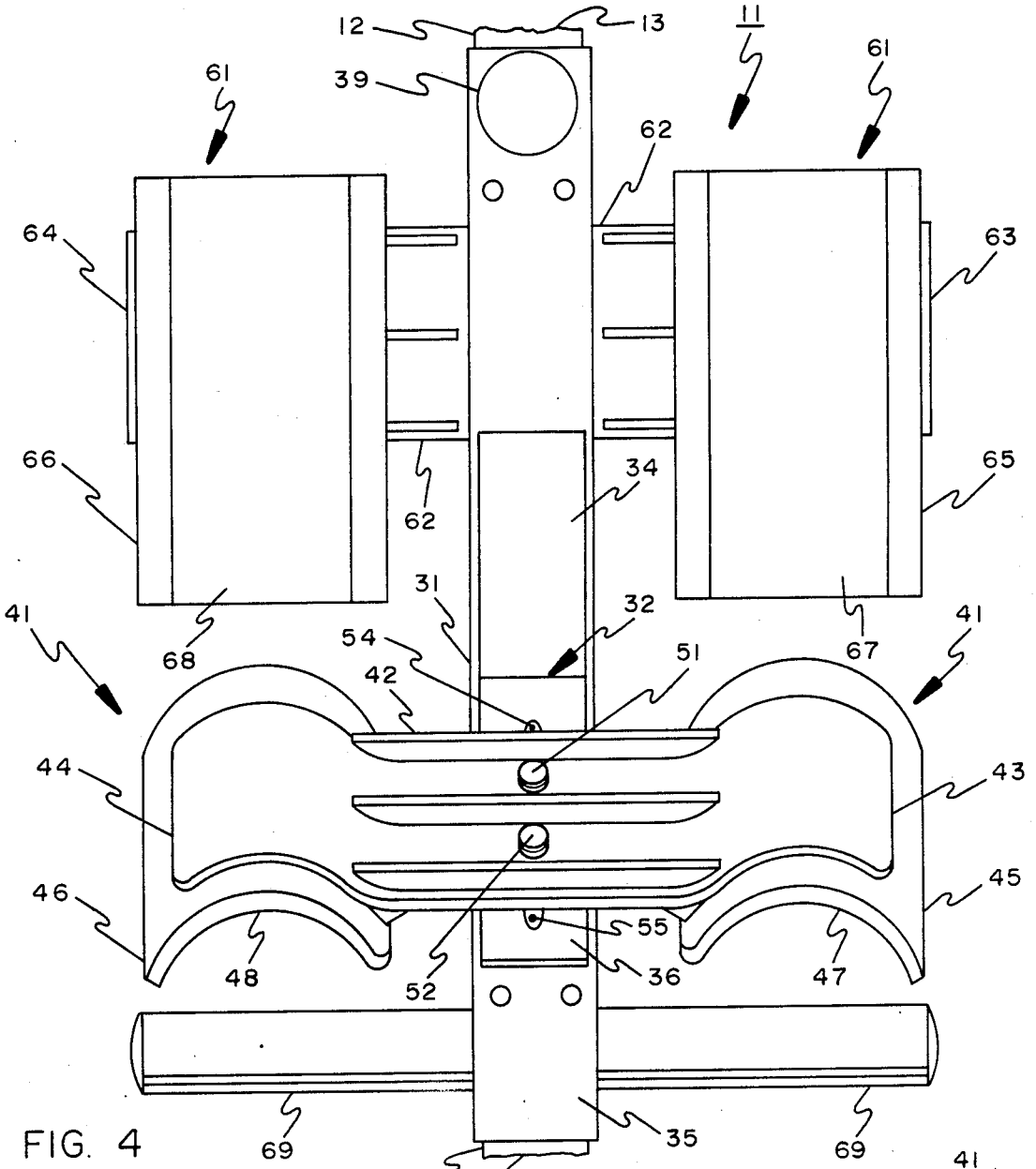
FIG. 4 is a top view of the improved, self-adjusting foot and leg holding structure of FIG. 1.

The central portion 42 of transverse member 41 is slidably supported upon the top surface 36 of upwardly extending section 33 by means of a pair of bolts 51 and 52, as shown in FIG. 4. Bolts 51 and 52 extend through a pair of spaced-apart holes in central portion 42 and through two centrally located, longitudinally extending slots 54 and 55, respectively. Slots 54 and 55 are located in upwardly extending section 33 of inclined bracket member 32, as seen in FIG. 2. The threaded ends of bolts 51 and 52 extend below the bottom surface of upwardly extending section 33 and receive locking nuts for securing the bolts in position.

The sliding movement of transverse member 41 in the forward or backward direction is determined by the longitudinal direction of slots 54 and 55. The amount of travel of transverse member 41 is determined by the length of slots 54 and 55. The width of slots 54 and 55 is just sufficient enough to allow easy sliding of the shaft portion of bolts 51 and 52 within the slots.

Lateral movement of transverse member 41, either to the left or to the right, is prevented by the presence of the shafts of bolts 51 and 52 within slots 54 and 55. Rotational movement of transverse member 41 about an axis perpendicular to the plane of top surface 36 of upwardly extending section 33 is prevented as a result of the use of the two spaced-apart bolts 51 and 52 extending through slots 54 and 55.

Figure 7:
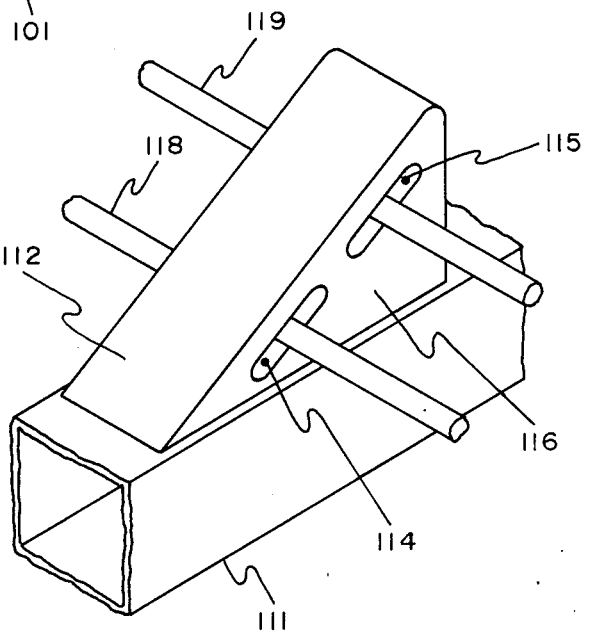
Figure 8:
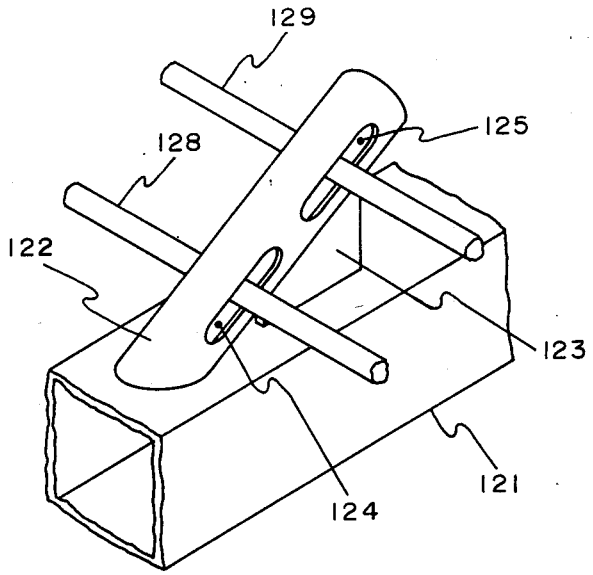

It is readily apparent to those skilled in the art that the simple slidable support system for transverse member 41, as illustrated, represents only one of a number of slidable support systems that are possible and which can achieve the desired movement of transverse member 41. For example, the slidable support system as disclosed in FIGS. 7 and 8 illustrates another of the many ways in which the desired, slidable movement of transverse member 41 may be achieved.

Left and right inverted U-shaped members 45 and 46 are attached, respectively, to the left and right end portions 43 and 44 of transverse member 41, as shown. While the left and right end portions 43 and 44 are themselves shaped as an inverted U and are secured to the rear surfaces of inverted U-shaped members 45 and 46, as by welding, it is apparent that transverse member 41, with its left and right end portions, and the left and right inverted U-shaped members could be formed as a single unitary structure, as by stamping where this member is made of metal, or by molding if formed of structural plastic or other suitable material.

Figure 5:
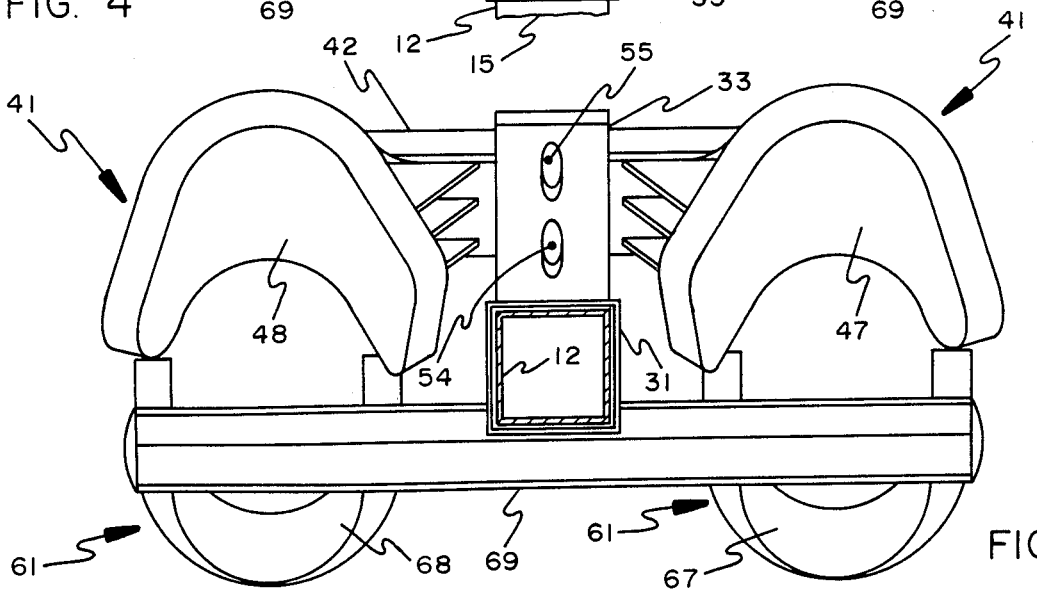
FIG. 5 is a view of the lower end of the foot and leg holding structure of FIGS. 1 and 4.

Inverted U-shaped members 45 and 46 are shaped and contoured to conform to the shape of the top portion of the foot. Left and right pads 47 and 48, of foam rubber or other suitable soft and resilient material, are attached to the inner surface of inverted U-shaped members 45 and 462, as illustrated in FIG. 5.

A second transverse member 61, having a central portion 62 and left and right laterally extending end portions 63 and 64, is attached to carriage support member 31 at a position between the upper end of carriage member 31 and first transverse member 41. As shown, the central portion 62 is attached to the bottom surface of carriage member 31, as by welding. The central portion 62 could, of course, be attached to the sides of carriage member 31, as by means of gussets or brackets, or to top surface 35, without departing from the scope of the invention.

The left and right end portions 63 and 64 are shown as having a U-shape and support left and right contoured U-shaped members 65 and 66. Members 65 and 66 are shaped to conform to the rear portion of the leg at a position above the ankle and below the calf. The inner surface of U-shaped members 65 and 66 support, respectively, left and right resilient pads 67 and 68.

For purposes of illustration, FIG. 1 shows, in broken lines, the outline of a leg and foot secured in the installed or locked position within the foot and leg holding structure 11 of the invention. In this illustration, the location of sliding transverse member 41, supporting inverted U-shaped member 44, is at an intermediate position between its first and second limits of travel. This location or position is the correct one for an average or medium size foot and leg. The position of transverse member 41 for a smaller foot and leg would be slidably moved farther backward, i.e., toward top surface 35 of carriage member 31. With a larger foot and leg, the location of transverse member 41 would be slidably moved farther forward, i.e., towards the tip of upwardly extending section 33. Transverse member 41 may be slidably positionable between its first and second limits by a distance of five to six centimeters or two to two and one-half inches.

When a tiltable body exerciser is set up in its upright position and ready for use, its bed or platform is elevated above the horizontally extending pivot axis, and its floor rest is in contact with the floor. In this position, the elongated central frame member 12 is inclined with respect to the floor by an angle that may vary between forty-five and sixty degrees, depending upon the design and settings of the tiltable body exerciser. The plane of top surface 36 of upwardly extending section 33, upon which transverse member 41 is mounted, is inclined with respect to central frame member 12 by an angle which may vary between forty-five and thirty degrees. By selecting the proper angle of inclination for top surface 36 of section 33 with respect to the longitudinal axis of central frame member 12, it can be seen that the plane of surface 36 will be approximately horizontal and, thus, parallel to the floor. With the plane of top surface 36 horizontal, first transverse member 41 is freely slidable in a horizontal plane between its first and second limits. Under this condition, transverse member 41 will remain stationary at whatever location it may be slidably positioned.

In using the self-adjusting foot and leg holding structure 11 of the present invention, the patient will first slidably move transverse member 41 to its forward limit. Then, from a standing position straddling the lower body supporting structure, one leg is raised and inserted through the gap or space between the foot and leg U-shaped members on one side of the structure, and then the sole of the foot is placed upon foot rest 69. Laterally extending foot rest 69 is attached to the bottom surface of carriage member 31 at its lower end. The other leg is then raised and inserted through the gap or space between the foot and leg U-shaped members on the opposite side, and then the sole of that foot is placed upon foot rest 69.

As the patient leans back upon the bed or platform to initiate the tilting movement of the exerciser, the lower end of central frame member 12 will be raised above the floor. As the plane of top surface 36 of section 33 begins to assume an inclined angle with the horizon, slidable transverse member 41, with its padded, inverted U-shaped members 43 and 44, will begin to slide, under the force of gravity, in its backward direction to embrace the top portions of the left and right feet. Upon further tilting movement of the exerciser, the inclination of the plane of top surface 36 will increase causing transverse member 41 to slidably move in a farther backward direction, thereby more firmly embracing the top portions of the left and right feet. In the inclined or inverted body position, the weight of the body acting through the feet will cause the sliding transverse member 41 to move in its backward direction, now substantially vertical, to achieve the locked-in position of the feet and legs as above described in the illustration of FIG. 1.

Figure 3:
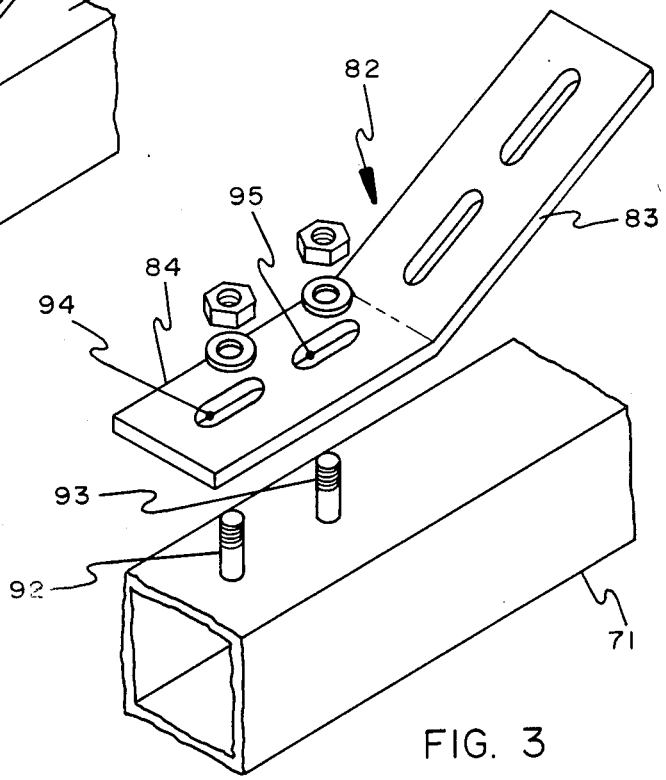
FIG. 3 is a perspective view of an embodiment of a portion of a sliding supporting structure of the invention.

FIG. 3 illustrates an embodiment of the supporting structure of the invention in which an inclined bracket member 82, having an upwardly extending section 83 and a flat base portion 84, is slidably mounted upon the top surface of support structure 71. A pair of threaded studs 92 and 93, spaced apart along the center line of support member 71, are securely attached to the top surface, as shown.

First and second spaced-apart longitudinally extending slots 94 and 95 are located in the center portion of the flat base 84 of bracket member 82. Flat base portion 84 may be held in slidable contact upon support member 71 by means of flat washers and self-locking nuts.

The slidable motion of bracket member 82 lies in the plane of the top surface of support structure 71, and the amount of sliding is determined by the length of slots 94 and 95. The upwardly extending section 83 is adapted for slidably mounting and supporting a transverse member 41, as above described in connection with FIGS. 1, 2, 4 and 5.

A short, slidable motion of bracket member 82 upon the top surface of support structure 71 of this embodiment of the invention will provide another self-adjustment, enabling the invention to firmly embrace and support the feet and legs of the patient.

Figure 6:
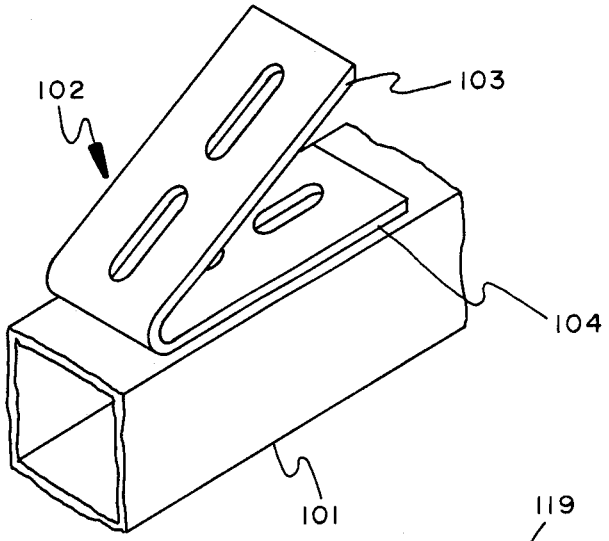
FIGS. 6, 7 and 8 are views illustrating in perspective alternative embodiments of portions of the supporting structure of the invention.

FIG. 6 illustrates an embodiment of the supporting structure in which an inclined bracket member 102 has an upwardly extending section 103, for slidably supporting a transverse member, and a flat base portion 104 for slidable mounting upon the top flat surface of support member 101. Flat base portion 104 is located below upwardly extending section 103, as shown. Inclined bracket member 102 may be mounted for sliding movement upon support member 101, as described above in connection with FIG. 3, or it may be welded to the top surface of member 101, as in FIG. 2.

FIG. 7 illustrates another embodiment of the supporting structure of the invention in which a hollow inclined housing 112 is mounted upon the top surface of support member 111. When viewed from the side, the inclined housing appears as a right triangle with two pairs of inclined, longitudinally extending slots 114 and 115 located in the side wall 116. A pair of inclined, matching slots (not shown) are similarly located in the side wall of inclined housing 112 opposite to side wall 116.

A pair of laterally extending rods 118 and 119 are rigidly secured to each other, within inclined housing 112, for slidable movement in the inclined plane determined by the slots 114 and 115, in wall 116, and the matching slots in the opposite wall. The rods 118 and 119 may be slidably movable in the same manner and to the same extent as the transverse member 41 in the embodiment of the invention described in FIGS. 1, 2, 4 and 5.

Removable, inverted, U-shaped padded members, for embracing the top portions of the feet, may be installed upon the end portions of rods 118 and 119 in the same manner as shown in U.S. Pat. No. 4,367,731.

FIG. 8 illustrates yet another embodiment of the supporting structure in which an inclined hollow cylinder 122 is securely mounted upon the top surface of support member 121, as by welding. A gusset 123 is welded between the lower surface of inclined cylinder 122 and the top surface of support member 121. Two pairs of spaced-apart, longitudinally extending slots 124 and 125 are located, as shown, in the side wall portion of inclined cylinder 122. An identical pair of slots are located in the opposite side wall.

Rods 128 and 129 are inserted through the inclined slots in cylinder 122 and are securely held together by means of an internal cylindrical tube or shaft member (not shown). The internally located cylindrical tube or shaft member is freely slidable within hollow cylinder 122, in telescoping fashion. The slidable movement of rods 128 and 129, with respect to support member 121, is identical to that as described in connection with FIG. 7 above and with that described in connection with the embodiment of the invention of FIGS. 1, 2, 4 and 5.

It is apparent that the improved self-adjusting foot and leg holding structure of the invention could be installed upon and formed as a part of the lower end of an elongated central frame member of a tiltable body exerciser without departing from the spirit and scope of the invention. In such embodiment, a slidable carriage member would be required.

Since many changes may be made in the above-described apparatus and many different embodiments of this invention could be made without departing from the scope thereof, it is intended that all matter contained in the above description or shown in the accompanying drawings shall be interpreted as illustrative and not in a limiting sense.

What is claimed is:

1. In a therapeutic device for the human body in which a main frame pivotally mounts a body supporting structure for longitudinally tilting movement about a horizontal axis, said body supporting structure having an elongated central frame member, an upper body supporting portion attached to the upper end portion of said elongated central frame member, and a lower body supporting portion adapted for secure engagement with the lower end portion of said elongated central frame member, the improvement wherein said lower body supporting portion comprises:

(a) a carriage member mounted upon and supported by the lower end portion of said elongated central frame member, said carriage member having a top surface, an upper end portion, a central portion, and a lower end portion, said carriage member being slidably positionable along the lower end portion of said elongated central frame member;

(b) an upwardly extending support section situated upon the top surface and attached to the central portion of said carriage member, said upwardly extending support section being inclined with respect to the top surface of said carriage member by an acute angle opening toward the lower portion of said carriage member;

(c) a first transverse member having a central portion slidably mounted upon said upwardly extending support section, said first transverse member having a left end portion extending laterally from said upwardly extending support section and a right end portion extending laterally from said upwardly extending support section, said first transverse member being slidable between first and second limits of travel upon said upwardly extending support section in a plane inclined with respect to the top surface of said carriage member by said acute angle;

(d) left and right inverted U-shaped members attached, respectively, to the left and right end portions of said first transverse member;

(e) a second transverse member having a central portion securely attached to the upper end portion of said carriage member, said second transverse member having a left end portion extending laterally from said carriage member and a right end portion extending laterally from said carriage member; and (f) left and right U-shaped members attached, respectively, to the left and right end portions of said second transverse member, the inner surface of said attached left and right U-shaped members being adapted for embracing and supporting, respectively, the rear area of the left and right legs of the human body between the ankle and the calf; the inner surface of said left and right inverted, U-shaped members, attached, respectively, to the left and right ends of said first slidably mounted transverse member, being adapted for embracing and supporting the top portions of the left and right feet, respectively.

2. The therapeutic device as defined by claim 1 wherein said upwardly extending support section situated upon the top surface and attached to the central portion of said carriage member is a bracket member, said bracket member having a flat base portion and an upwardly extending portion, the flat base portion of said bracket member being securely attached to the top surface of the central portion of said carriage member, the upwardly extending portion of said bracket member supporting the central portion of said first transverse member for sliding motion in said acute plane between the first and second limits of travel.

3. The therapeutic device as defined by claim 1 wherein said upwardly extending support section situated upon the top surface and attached to the central portion of said carriage member is an inclined housing, said inclined housing including means for supporting the central portion of said first transverse member for sliding motion in said acute plane between the first and second limits of travel.

4. The therapeutic device as defined by claim 1 wherein said carriage member is a substantially square, hollow tube and wherein said square, hollow tube is slidably mounted upon and supported by the lower end portion of a the central frame member.

5. The therapeutic device as defined by claim 1 wherein said first transverse member and said left and right inverted U-shaped members are formed as a unitary structure.

6. The therapeutic device as defined by claim 1 wherein said second transverse member and said left and right U-shaped members are formed as a unitary structure.

7. The therapeutic device as defined by claim 1 further comprising a foot rest securely attached to the lower end portion of said carriage member, said foot rest having left and right portions extending laterally from said carriage member and situated, respectively, below said left and right inverted U-shaped members.

* * * * *